US011821711B2

(12) United States Patent
Teng et al.

(10) Patent No.: US 11,821,711 B2
(45) Date of Patent: Nov. 21, 2023

(54) ONLINE DART COMPETITION SYSTEM

(71) Applicant: NVTEK ELECTRONIC CO., LTD., Zhubei (TW)

(72) Inventors: Wen-Chih Teng, Zhubei (TW); Chin-Wei Liu, Hsinchu County (TW)

(73) Assignee: NVTEK Electronic Co., Ltd., Zhubei (TW)

( * ) Notice: Subject to any disclaimer, the term of this patent is extended or adjusted under 35 U.S.C. 154(b) by 403 days.

(21) Appl. No.: 17/326,809

(22) Filed: May 21, 2021

(65) Prior Publication Data

US 2022/0373304 A1 Nov. 24, 2022

(51) Int. Cl.
*F41J 3/00* (2006.01)
*F41J 5/052* (2006.01)
*F41J 3/02* (2006.01)

(52) U.S. Cl.
CPC ..... *F41J 3/0009* (2013.01); *F41J 3/02* (2013.01); *F41J 5/052* (2013.01)

(58) Field of Classification Search
CPC .... F41J 3/0009; F41J 3/02; F41J 5/052; F41J 5/00
See application file for complete search history.

(56) References Cited

FOREIGN PATENT DOCUMENTS

| | | | |
|---|---|---|---|
| CN | 205883448 | U | 1/2017 |
| CN | 104936664 | B | 4/2018 |
| CN | 109069930 | A | 12/2018 |
| CN | 109310927 | A | 2/2019 |
| DE | 102016000210 | A1 | 7/2016 |

*Primary Examiner* — Kevin Y Kim
(74) *Attorney, Agent, or Firm* — Rosenberg, Klein & Lee

(57) ABSTRACT

An online dart competition system including at least two mobile devices having a first and a second image capturing module, configured to capture an dart player image and a dartboard image, respectively; a mirror to reflect/redirect the dartboard image; a wireless transmission module, configured to transmit a score, the dart player image, and the dartboard image to the other mobile device and to receive a score, image, and a dartboard image of a competitor from the other mobile device; and a processor. The processor executes an application and displays the scores and at least two images of the dart player image, the dartboard image, the competitor image, and the competitor dartboard image on a display in a split-screen interface. Thus, the at least two images may be viewed by players during the online competition.

20 Claims, 8 Drawing Sheets

ONLINE DART COMPETITION SYSTEM

FIELD

The present invention relates to a game system, and in particular to an online dart competition system.

BACKGROUND

In recent years, a dart game has developed into a worldwide leisure game, and male or female players of various ages can enjoy the dart game. Participants in the dart game usually need to gather in the same place to play and take turns throwing a dart on the same target surface. However, with the development of the communication technology, electronic dart game machine consoles have been developed, these electronic dart game machine consoles are connected in series through at least one host computer by means of the Internet so that the participants can overcome the limitations from time and place and participate in the dart competition in a remote mode. Specifically, two cameras are arranged on the electronic dart game machine console to separately shoot images of a target surface and a competitor, and remotely transmit the process and result of the game through a network. In addition, the electronic dart game machine console may electronically sense a hit point of a dartboard, thereby automatically summing up the scores and then providing a summary score for the competitor. However, the electronic dart game machine console is expensive in cost and large in size, a general consumer cannot afford it or it is difficult to put it at home, and therefore, it is usually arranged in an amusement place or other public places by an entertainment provider. Even so, a consumer cannot be online with others to enjoy the fun of the dart competition if it is inconvenient for the consumer to go out.

In view of this, for the deficiencies of the above-mentioned prior art and the prospect of the future market demand, the inventor proposes an online dart competition system, in order to effectively solve the above-mentioned problems, and the specific structure and the implementation thereof will be described in detail below:

SUMMARY

An object of the present invention is that a dart player can participate a global dart competition against other in different place by merely two mobile devices capable of obtaining images of all players and dartboards and scores thereof when they are playing with traditional dart board without auto scoring function.

Another objective of the present invention is that a dart player and a remote competitor can see a screen showing player image, a screen of dartboard image and an actual score of each other and thereby a dart competition in a remotely online mode is achieved.

Another objective of the present invention is to provide a mobile device capable of capturing the dart player image and the dartboard when a dart player, the mobile device and a dartboard are not on one straight line.

Another objective of the present invention is to provide the mobile device externally connected to an image capturing module, so as to solve the problem that the mobile device cannot simultaneously turn on the front and rear cameras.

In order to achieve the above-mentioned objectives, the present invention provides an online dart competition system, comprising: at least two mobile devices, any one of which comprises: a first image capturing module, configured to capture an dart player image from an dart player; a mirror, arranged in front of or beside the mobile device and configured to reflect or redirect a dartboard image of a dartboard; a second image capturing module, configured to capture the dartboard image from the mirror; a score input element, configured to receive a dart player score corresponding to the dartboard image either inputted manually by the dart player via a touch panel or other user input device, or received from a score sensing module; a display; a processor, connected with the first image capturing module, the second image capturing module, the score input element, and the display; and a wireless transmission module, connected with the first image capturing module, the second image capturing module, and the processor, wherein the wireless transmission module is configured to transmit the dart player score, the dart player image and the dartboard image to the other mobile device and is configured to receive a competitor score, a competitor image and a competitor dartboard image from the other mobile device; and wherein the processor executes an online match, league or tournament application and then simultaneously displays the dart player score, the competitor score, and at least two images of the dart player image, the dartboard image, the competitor image, and the competitor dartboard image on the display in a split-screen interface, and the online match, league or tournament application is configured to record the dart player score and the competitor score.

According to the embodiments of the present invention, each of the at least two mobile devices further comprises: a reflecting element, arranged in front of or beside the mobile device and reflecting the dartboard image to the second image capturing module.

According to the embodiments of the present invention, the processor further includes a scoring module, recording and summing up a score of each dart on the dartboard.

According to the embodiments of the present invention, the split-screen interface comprises a score field, and the online match, league or tournament application performs a first display mode and a second display mode, in the first display mode, the online match, league or tournament application displays the number of rounds, a score of each round, and a game count of the dart player and the competitor on the score field; and in the second display mode, the online match, league or tournament application displays the game count on the score field.

According to the embodiments of the present invention, the online dart competition system further includes a cloud server, connected with the wireless transmission module of the at least two mobile devices and configured to receive, transmit, and record the dart player score, the competitor score, the dart player image, the dartboard image, the competitor image, and the competitor dartboard image and the score of each dart.

According to the embodiments of the present invention, the online dart competition system further includes at least one media device, connected to the cloud server for the dart player score, the competitor score, and the images to be viewed.

According to the embodiments of the present invention, the processor further includes an image processing module, configured to zoom, turn, or cut the at least two images and then combine the at least two images in the split-screen interface.

According to the embodiments of the present invention, the first image capturing module is a front camera of the mobile device.

According to the embodiments of the present invention, the second image capturing module is a rear camera of the mobile device.

In order to achieve the above-mentioned objectives, the present invention further provides an online dart competition system, comprising: an online dart competition system, comprising: at least two mobile devices, any one of which comprises: a first image capturing module, configured to capture an dart player image from an dart player; a second image capturing module, connected with the mobile device through a transmission cable and configured to capture a dartboard image from a dartboard and to transmit the dartboard image to the mobile device after capturing the dartboard image; a score input element, configured to receive a dart player score corresponding to the dartboard image either inputted manually by the dart player via a touch panel or other user input device, or received from a score sensing module; a display; a processor, connected with the first image capturing module, the second image capturing module, the score input element, and the display; and a wireless transmission module, connected with the first image capturing module, the second image capturing module, and the processor, wherein the wireless transmission module is configured to transmit the dart player score, the dart player image and the dartboard image to the other mobile device and is configured to receive a competitor score, a competitor image and a competitor dartboard image from the other mobile device; and wherein the processor executes an online match, league or tournament application and then simultaneously displays the dart player score, the competitor score, and at least two images of the dart player image, the dartboard image, the competitor image, and the competitor dartboard image on the display in a split-screen interface, and the online match, league or tournament application is configured to record the dart player score and the competitor score.

According to the embodiments of the present invention, the second image capturing module is a miniature camera or Webcam.

DETAILED DESCRIPTION OF THE EMBODIMENTS

The present invention provides an online dart competition system, which is applied to a multi-person dart competition of at least two persons, by means of mobile devices communication with one another through a cloud, the competition can be broadcast live through videos or rebroadcast on the spot to other viewers, and the objective of being remotely online to perform the dart competition can also be achieved even if a professional dartboard with a network online function is not used.

Figure 1:
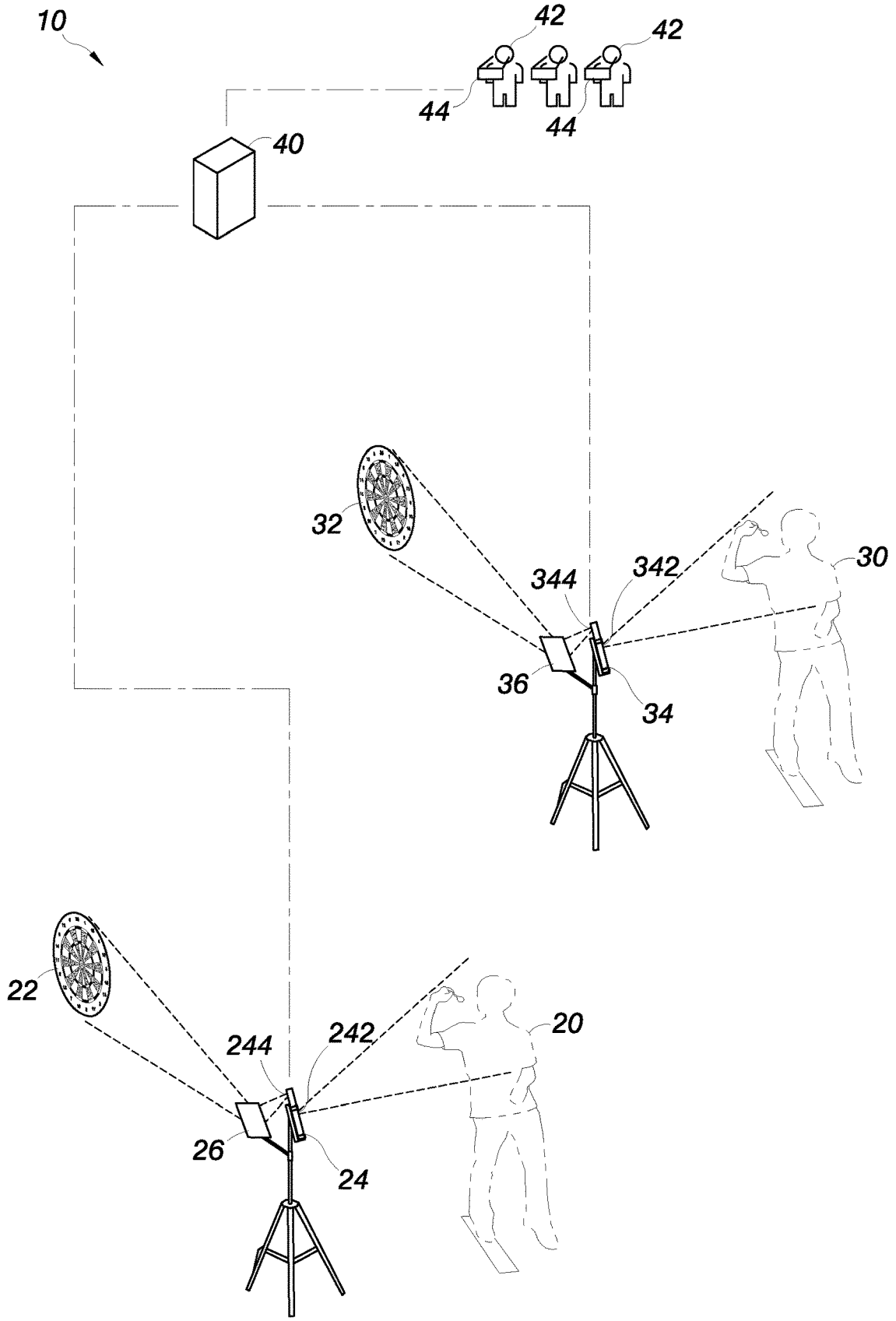
FIG. 1 is a schematic diagram of one embodiment of an online dart competition system of the present invention.

Refer to FIG. 1, which is a schematic diagram of the first embodiment of the online dart competition system 10 of the present invention. The online dart competition system 10 of the present invention includes at least two mobile devices. In this embodiment, it is a competition in which a first dart player 20 and a second dart player 30 participating. The first dart player 20 and the second dart player 30 are in different place, or may even be located in different countries. The mobile device 24 is utilized to capture images of the first dart player 20 who throws a dart and the dartboard 22. The mobile device 34 is utilized to capture images of the second dart player 30 who throws a dart and the dartboard 32. The mobile devices 24 and 34 may be smart phones or tablet computes.

In an embodiment, the mobile devices 24 and 34 are both connected to a cloud server 40 via a wireless communication network. The mobile device 24 transmits a first dart player score and the images of the first dart player 20 and the dartboard 22 to the mobile device 34 through the cloud server 40, and the mobile device 34 transmit a competitor score and the images of the second dart player 30 and the dartboard 32 to the mobile device 24 through the cloud server 40. The first dart player score, the competitor score, and the images of the first dart player 20, the dartboard 22, the second dart player 30 and the dartboard 32 will be stored or temporarily stored in the cloud server 40. However, the present invention should not limited to the above-mentioned structure. In some embodiments, the mobile devices 24 and 34 may connected with each other via a wireless communication network and perform the aforementioned data transmission.

Figure 2:
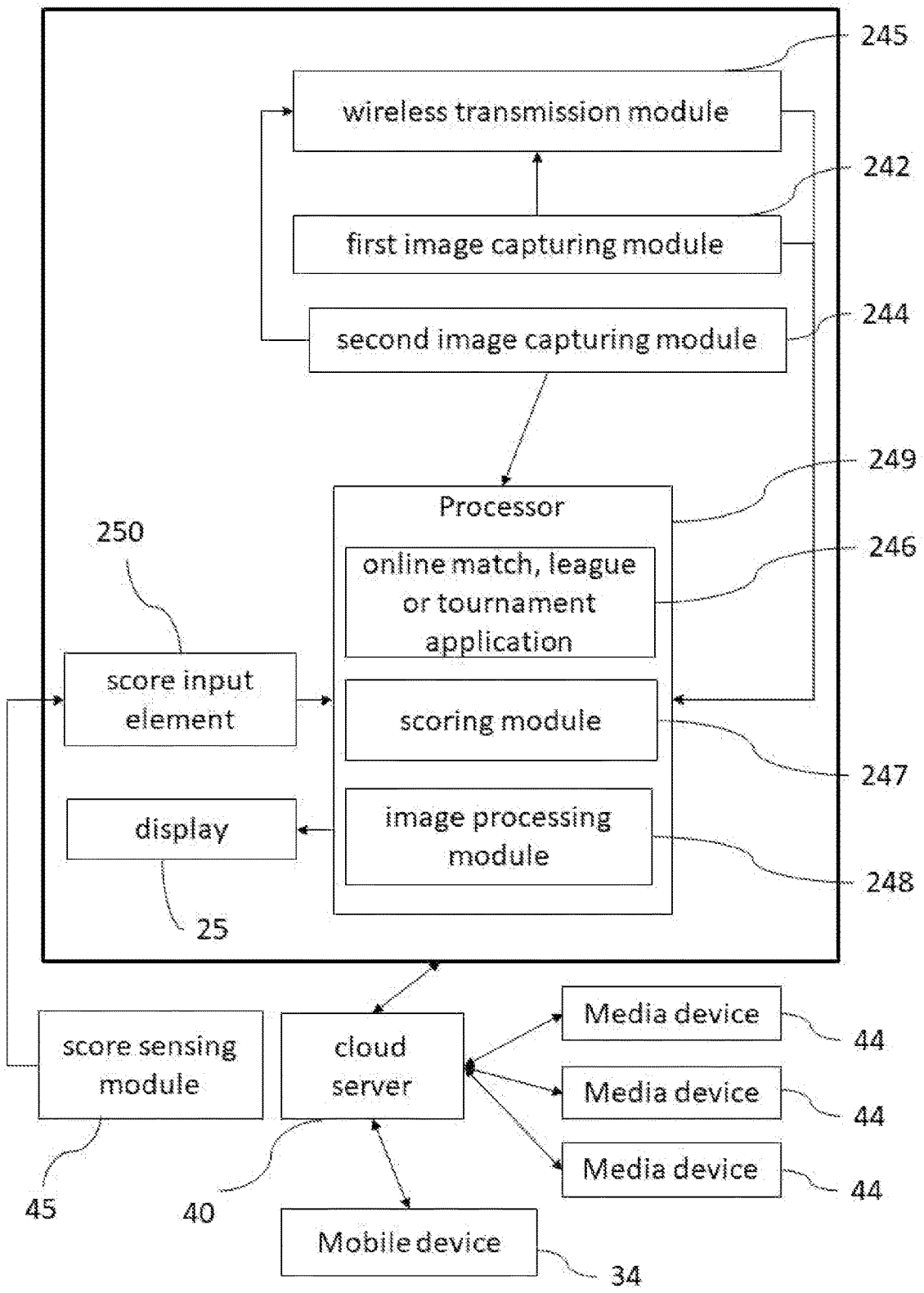
FIG. 2 is a block diagram of the online dart competition system of the present invention.

Refer to FIG. 1 and FIG. 2, wherein the FIG. 2 is a block diagram of the system of the present invention. In an embodiment, the mobile device 24 and/or 34 includes the following components (taking the mobile device 24 as an example): a first image capturing module 242, a second image capturing module 244, a score input element 250, a display 25, a wireless transmission module 245, and a processor 249. The first image capturing module 242 is arranged in a front side of the mobile device 24 and configured to capture the image of the first dart player 20. In other words, the first image capturing module 242 is a front camera of the mobile device 24. The second image capturing module 244 is arranged in a rear side of the mobile device 24 and configured to capture the dartboard image 22. In other words, the second image capturing module 244 is a rear camera of the mobile device 24. The score input element 250 is a user input device, such as a touch device, keyboard, or a mouse, etc. The score input element 250 is configured to receive a dart player score corresponding to the dartboard image either inputted manually by the first dart player 20, or received from a score sensing module 45. The display 25 is described in other paragraph with FIG. 3. The score sensing module 45 is described in other paragraph with FIG. 8 and FIG. 9. The processor 249 is connected with the first image capturing module 242, the second image capturing module 244, the score input element 250 and the display 25.

The wireless transmission module 245 is connected to the first image capturing module 242, the second image capturing module 244, and the processor 249. To allow worldwide dart players to join a thrilling competition at home easily, an online match, league or tournament application 246 installed in the mobile device 24 and executed by the processor 249 is provided. The wireless transmission module 245 is configured to transmit the dart player score, the image of the first dart player 20, and the dartboard image 22 to the other mobile device 34 participating in a competition. In addition, the wireless transmission module 245 is configured to receive a competitor score, the images of the second dart player 30, and the other dartboard 32 transmitted by the other one (that is, the mobile device 34) of the mobile devices participating in a competition. The online match, league or tournament application 246 executed by the processor 249 is a dart competition application installed in the mobile device 24. The processor 249 is connected with the first image capturing module 242, the second image capturing module 244 and the wireless transmission module 245, and configured to selects at least two images from the images of the first dart player 20, the dartboard 22, the second dart player 30 and the dartboard 32 to simultaneously displays the same, dart player score, and the competitor score on the display in a split-screen interface. The at least two images displayed in a split-screen interface are selected and displayed according to a preset or the selection of the first dart player 20. In this embodiment, the mobile device 24 or 34 further comprises a storage device. The online match, league or tournament application 246 is stored in the storage device, executed by the processor, and displayed by the display. The online match, league or tournament application 246 is configured to record the dart player score and the competitor score.

The processor 249 further includes a scoring module 247 and an image processing module 248, wherein the scoring module 247 is configured to record and sum up a score of each dart on the dartboard 22. In the present invention, the score of the dart may be automatically counted or manually inputted on the user input device. Since the dartboard image 22 will be transmitted to the other competitor for being viewed, the other competitor can clearly identify a landing point of the dart and a deserving score, and in other words, even if the score is manually input, there is no doubt about cheating. The image processing module 248 is configured to perform actions of zooming, turning, cutting or the like on the images of the first dart player 20, the dartboard 22, the second dart player 30 and the dartboard 32 and put the same into a split screen.

Considering that when the mobile device 24 is placed between the first dart player 20 and the dartboard 22 and is located on the same straight line, the first dart player 20 may hit the mobile device 24 while throwing the dart, and therefore, the mobile device 24 must be placed at a position close to a side. As a result, if the first image capturing module 242 (that is, the front camera) directly faces the first dart player 20, the second image capturing module 244 (that is, the rear camera) cannot photograph the dartboard 22. In view of this, in the embodiment in FIG. 1 of the present invention, a reflecting element is provided and the reflecting element may be a mirror. The mirror 26 is arranged in front of or beside the mobile device 24, and the angle of the mirror 26 is adjusted to reflect or redirect the dartboard image 22 to the second image capturing module 244. Since lenses of the mobile devices 24 of different brands and models have different processing modes for the captured images, the images generated by certain lenses will be reversed left and right or become left-to-right reversed images after reflected by the mirror 26. For example, the first dart player 20 is a right-hander, but is displayed as a left-hander after the image is transmitted to the mobile device 34 of the second dart player 30. Therefore, the image processing module 248 is required to adjust the image to the correct direction so as to avoid misjudgment.

The mirror 26 may be installed on the mobile device 24 or connected to the mobile device 24 by utilizing a universal joint (not shown), so that the mirror 26 can be rotated at will to adjust the angle. Alternatively, the mobile device 24 and the mirror 26 are both fixed to at least one stand (not shown). There are other more methods for placing the mirror 26, which are all included within the scope of the present invention as long as the mirror 26 is arranged in front of or beside the mobile device 24 and can reflect or redirect the dartboard image 22 into the second image capturing module 244.

Figure 3:
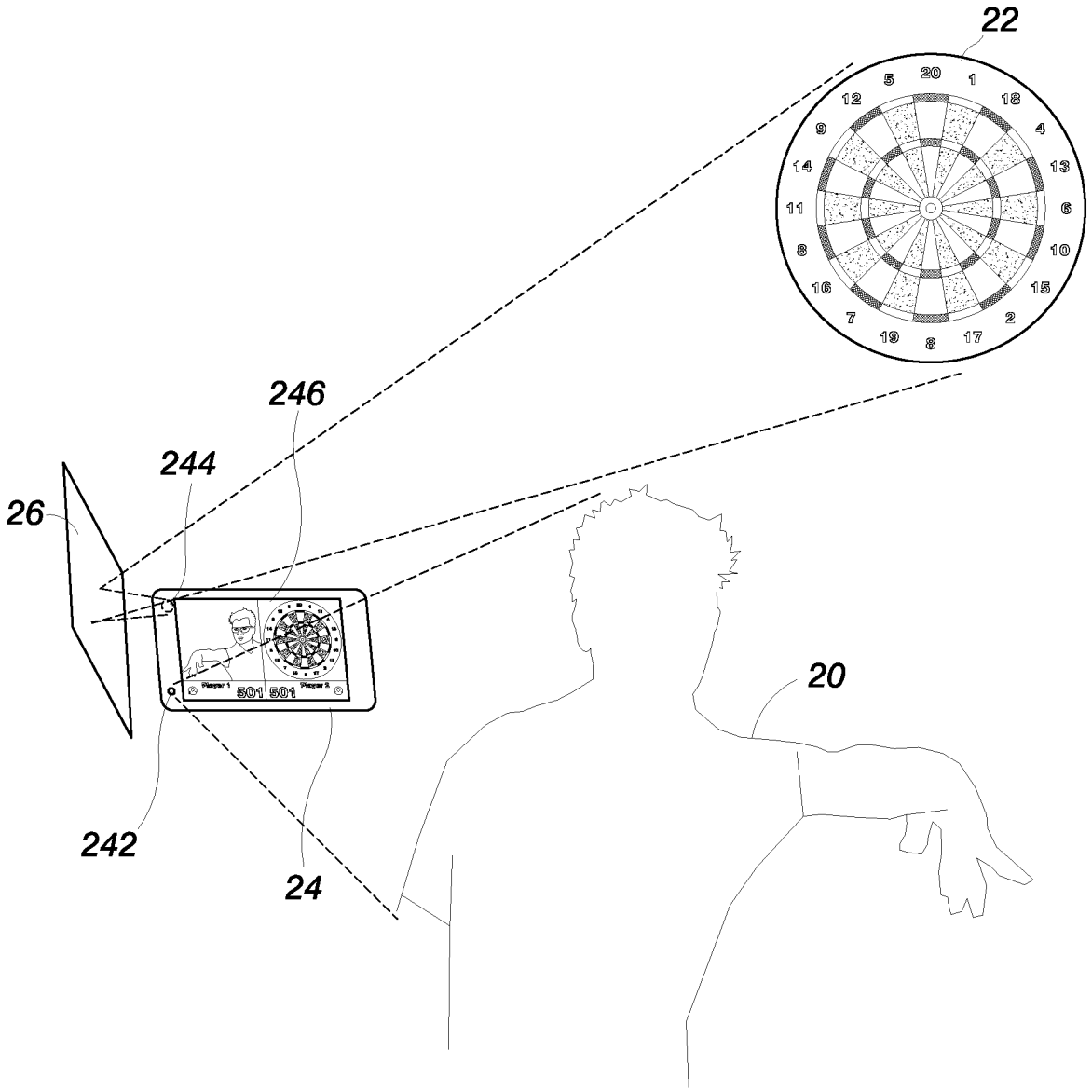
FIG. 3 is a schematic diagram of throwing a dart by a first dart player in the online dart competition system of the present invention.
Figure 4:
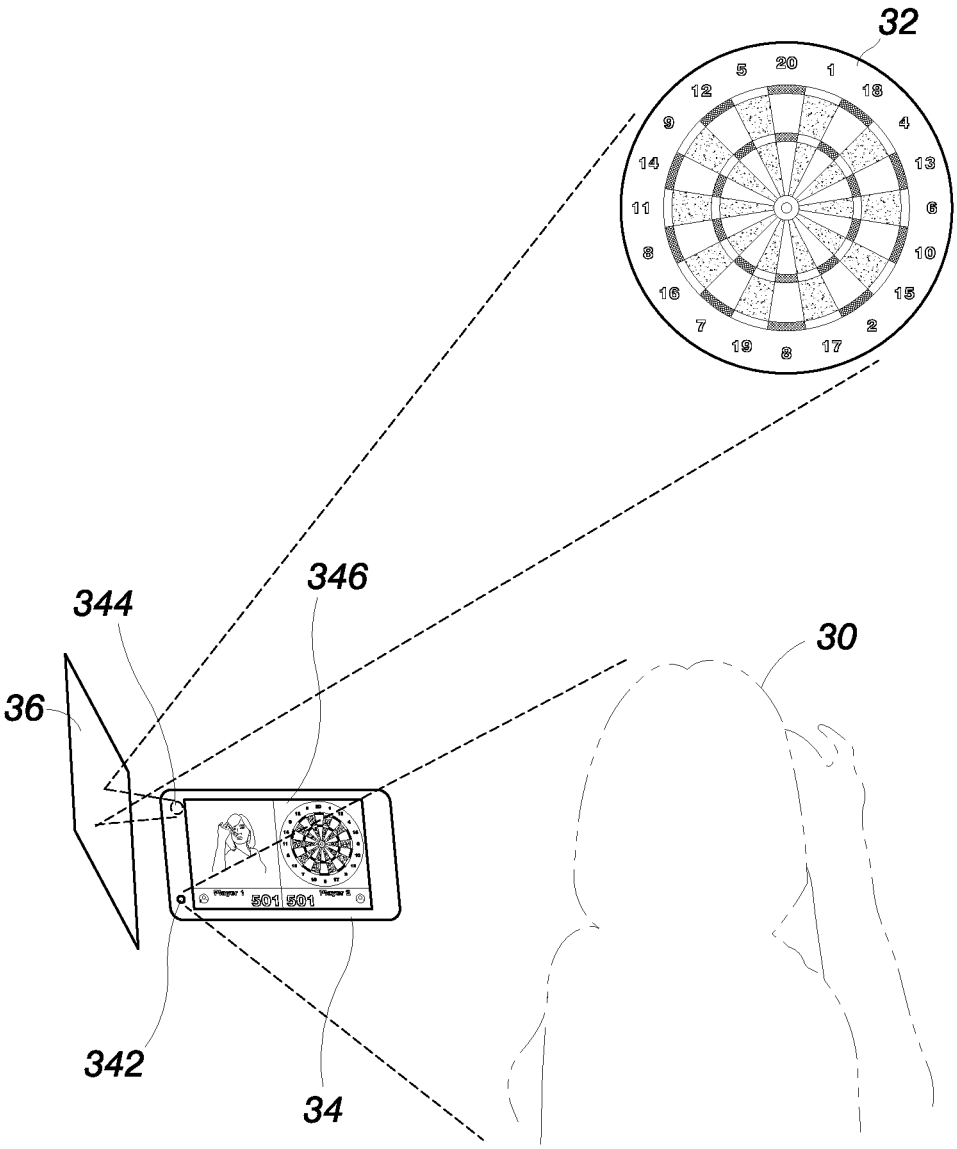
FIG. 4 is a schematic diagram of throwing a dart by a second dart player in the online dart competition system of the present invention.

FIG. 3 is a schematic diagram of throwing the dart by the first dart player 20 in the online dart competition system of the present invention. The first dart player 20 is a competitor of a local end, that is, the competitor himself/herself. It can be apparently seen from FIG. 3 that the mirror 26 is placed in front of or beside the mobile device 24 to reflect or redirect the dartboard image 22 to the rear camera of the mobile device 24. Similarly, FIG. 4 is a schematic diagram of throwing the dart by the second dart player 30 in the online dart competition system of the present invention. The second dart player 30 is a remote competitor, that is, a competition opponent. FIG. 4 and FIG. 3 are the same in that they both adopt a mode that mirrors 26 and 36 reflect or redirect the images of the dartboards 22 and 32 to the rear cameras 244 and 344, so that the mobile devices 24 and 34 to separately and simultaneously acquire the images of the first dart player 20, the dartboard 22, the second dart player 30 and the dartboard 32 through the front and rear cameras thereof, and separately present the images on the online match, league or tournament applications 246 and 346 in a split-screen interface. In the present invention, the online match, league or tournament applications 246 and 346 provide a first display mode and a second display mode and determine which one of the first and second display modes to be on the mobile device 24 and 34. In the first display mode, the display 25 of the mobile device 24 is as shown in FIG. 6 when the first dart player 20 is a thrower. In the second display mode, the display 25 of the mobile device 24 is as shown in FIG. 5 when the first dart player 20 gets a bye.

Figure 5:
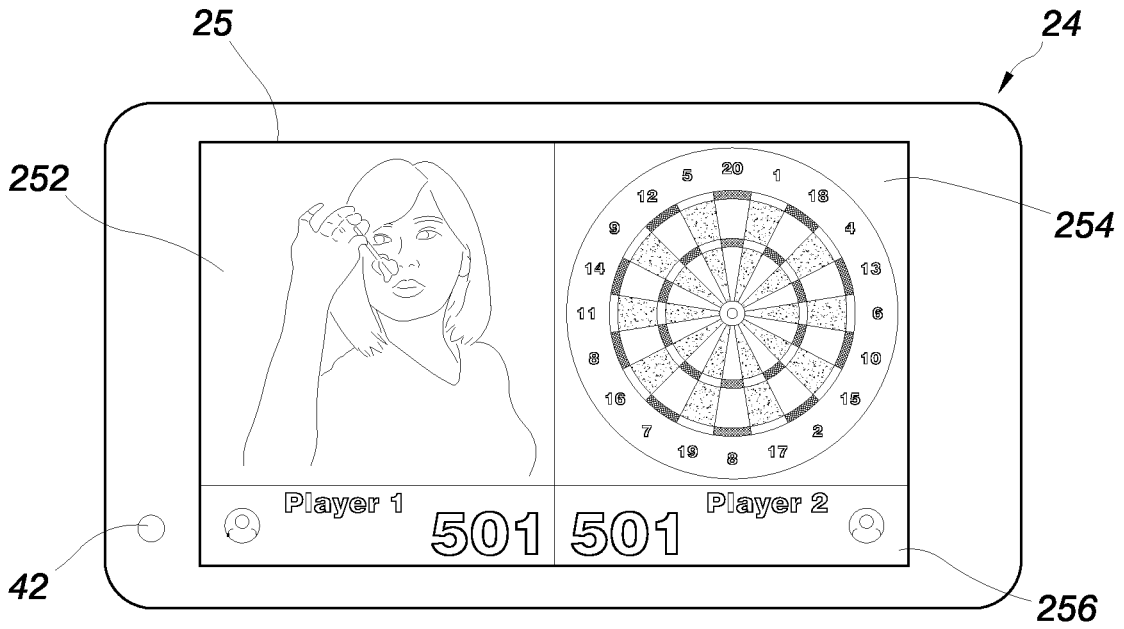
FIG. 5 shows one embodiment of an dart player interface of an online match, league or tournament application of the online dart competition system of the present invention.
Figure 6:
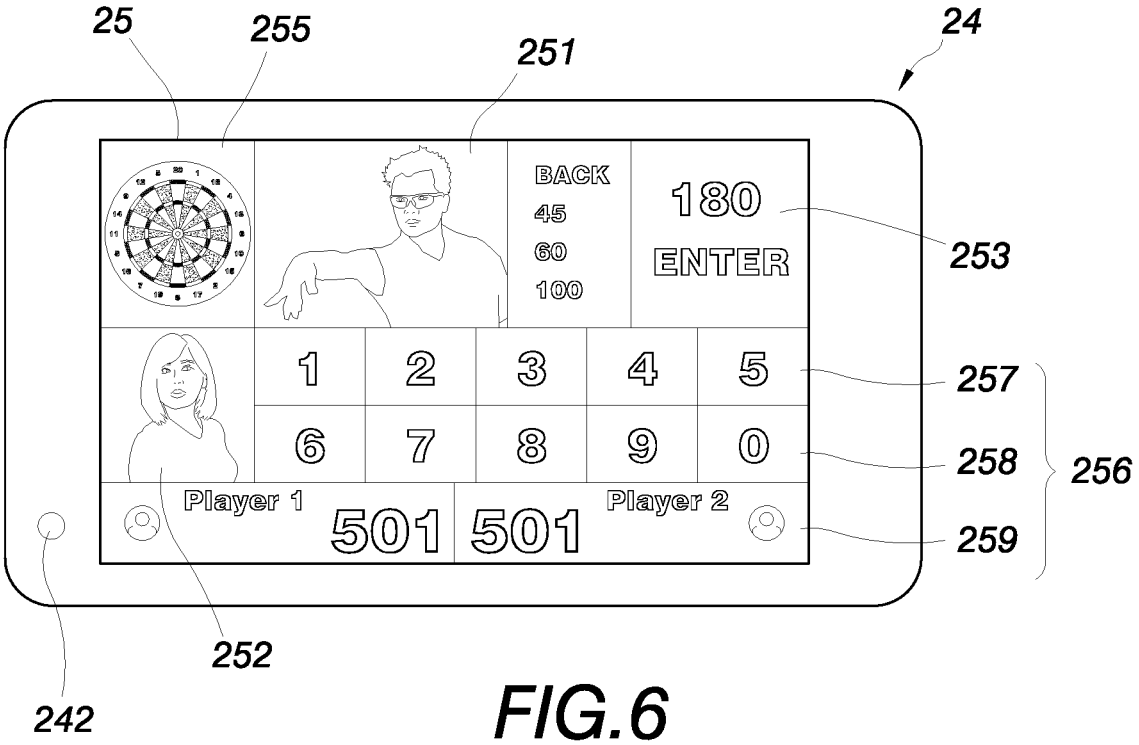
FIG. 6 shows another embodiment of the dart player interface of the online match, league or tournament application of the online dart competition system of the present invention.

FIG. 5 shows one embodiment of an dart player interface of the online match, league or tournament application of the online dart competition system of the present invention. In this embodiment, the mobile device 24 of the first dart player 20 is illustrated, and a screen displayed on a display 25 is a screen of throwing a dart by a remote second dart player. In this display 25, the screen is divided into three blocks, that is, a remote dart player screen 252, a remote dartboard screen 254 and a score field 256 separately. The remote dart player screen 252 and the remote dartboard screen 254 are transmitted through the cloud server and displayed for being viewed by the first dart player of the local end, so that the throwing performance of the second dart player and the score of dart throwing may also be seen even if the first dart player is not at the throwing scene of the second dart player. The score field 256 displays the dart player score and the competitor score, referring to the total game count of both. These scores may further be recorded in the cloud server 40 in addition to being transmitted to the mobile device of the other dart player through the cloud server 40.

FIG. 6 shows another embodiment of the dart player interface of the online match, league or tournament application of the online dart competition system of the present invention. In this embodiment, it still is the mobile device 24 of the first dart player 20 that is illustrated, but the first dart player 20 takes turn to be a dart thrower. At the moment, a screen picture of the second dart player is as shown in FIG. 5. In the display 25 of the mobile device 24 of the first dart player, the screen is divided into five blocks, that is, a local end dart player screen 251, a local end dartboard screen 255, a remote dart player screen 252, a round score 253 and a score field 256 separately. The remote dart player screen 252 is transmitted through the cloud server and displayed for being viewed by the first dart player of the local end. The score field 256 displays the number of rounds 257, a score of each round 258 and a game count of both 259 in the a display mode. The score field 256 displays a game count of both 259 in the a display mode. For example, FIG. 6 shows that there are 5 rounds in total, and a score of each round separately is 6, 7, 8, 9 and 0. Since the scores and multiples of each block on the dartboard are different, further there is a block of the game score 253 on the display 25 to display a total score of the 5 rounds of this game, and in the embodiment in FIG. 6, a score of this game is 180 points.

In combination with the embodiments in FIGS. 5 and 6, both the throwing image of the thrower and the dartboard image will be simultaneously displayed in the mobile devices of both. In addition, when the first dart player is the thrower, the score field 256 displays the number of rounds 257, the score of each round 258, the game count of both 259 and the like, and when the first dart player gets a bye, the score field 256 displays only the game count of both. However, this is only one embodiment, there are more kinds of changes on the screen splitting modes, the selection of the displayed images and the like, and the embodiments of the present invention do not limit the specific implementation to being only as shown in FIGS. 5 and 6.

Figure 7:
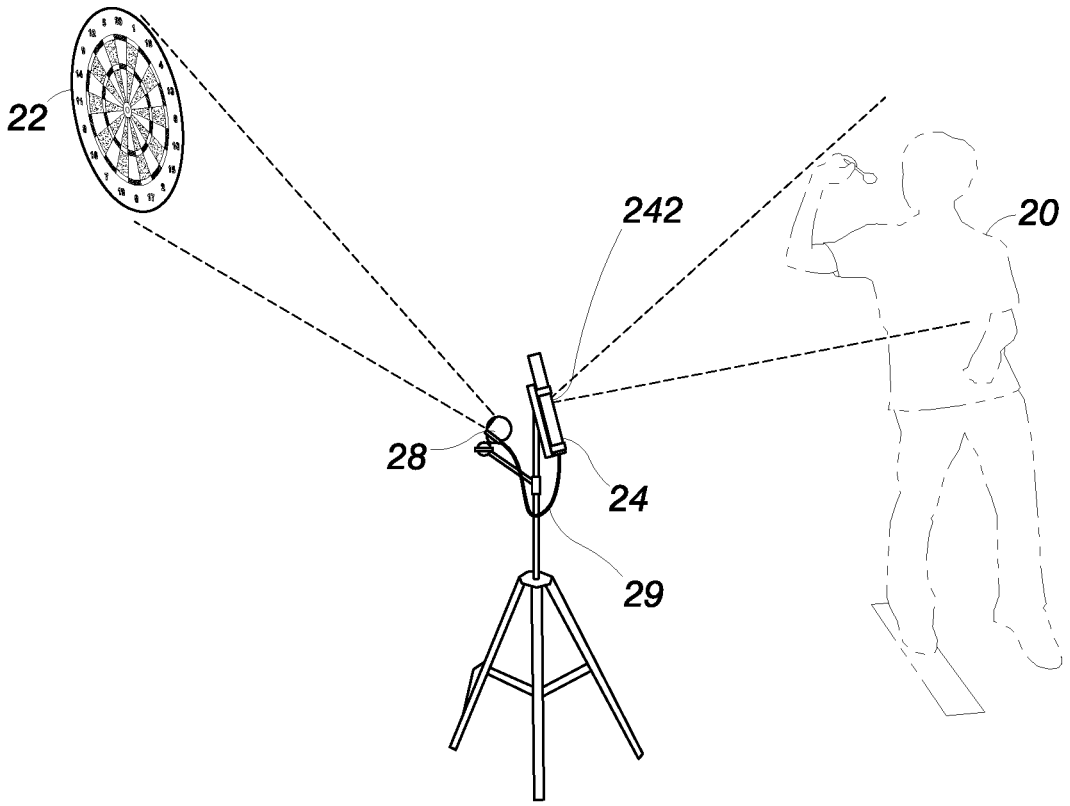
FIG. 7 is a schematic diagram of another embodiment of throwing a dart by an dart player in the online dart competition system of the present invention.

FIG. 7 is a schematic diagram of another embodiment of throwing a dart by an dart player in the online dart competition system of the present invention. In this embodiment, the first dart player 20 only uses the front camera of the mobile device 24 as the first image capturing module 242 to capture the image of the first dart player 20. However, the dartboard image 22 is photographed by another kind of second image capturing module, wherein the second image capturing module may be a miniature camera or Webcam. In the embodiment in FIG. 7, the Webcam 28 is adopted as the second image capturing module. The Webcam 28 (or miniature camera) is connected to a port of the mobile device 24 by utilizing a transmission cable 29 to transmit the photographed and captured dartboard image 22 to the mobile device 24. The port of the mobile device 24 may be a charging hole, a headphone hole or other interfaces.

Refer to FIG. 1 and FIG. 2, the cloud server 40 may further be connected to at least one media device 44. Since competition images of the first dart player 20 and the second dart player 30 are both transmitted to the cloud server 40, the cloud server 40 may further selectively open the images to other viewers 42 for being viewed. The media device 44 may be a computer, a smart phone, a tablet computer or the like, and the online match, league or tournament application is installed in the media device 44. When the online match, league or tournament application installed in the media device 44 is turned on by the viewer 42 and online with the cloud server 40, which competitions are currently being online through the cloud server 40 and which competitions are open to allow the viewer 42 to enter for viewing a live broadcast are displayed. Whether a competition is open to the viewer 42 for being viewed is determined by the first dart player 20 and the second dart player 30 and is set on the online match, league or tournament application 246. The viewer 42 can view an on-the-spot rebroadcast of the opening dart competition on the media device 44 after selecting to enter one of the competitions open for being viewed. For instance, the media device 44 display the images to be viewed online by streaming.

Figure 8:
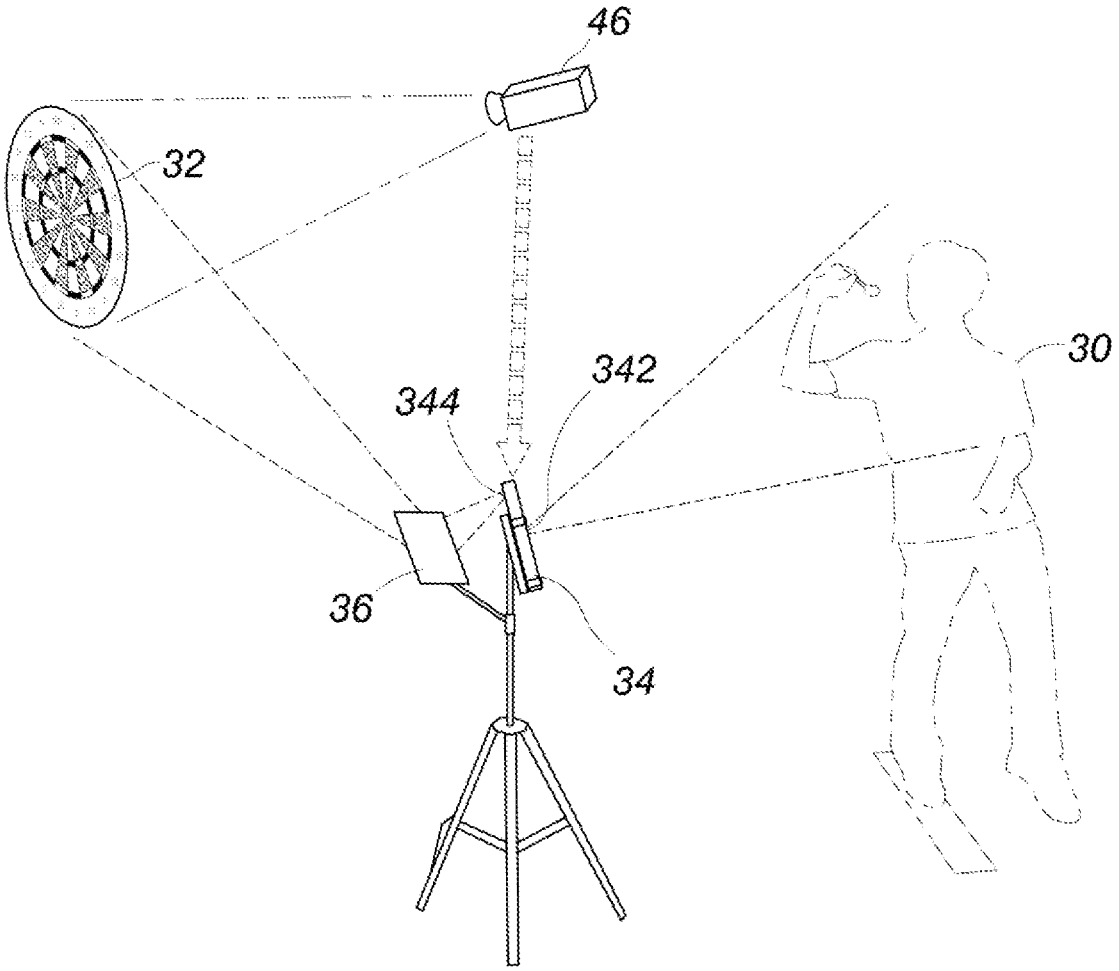
FIG. 8 is a schematic diagram of the embodiment with a first score sensing module additionally arranged in the present invention.
Figure 9:
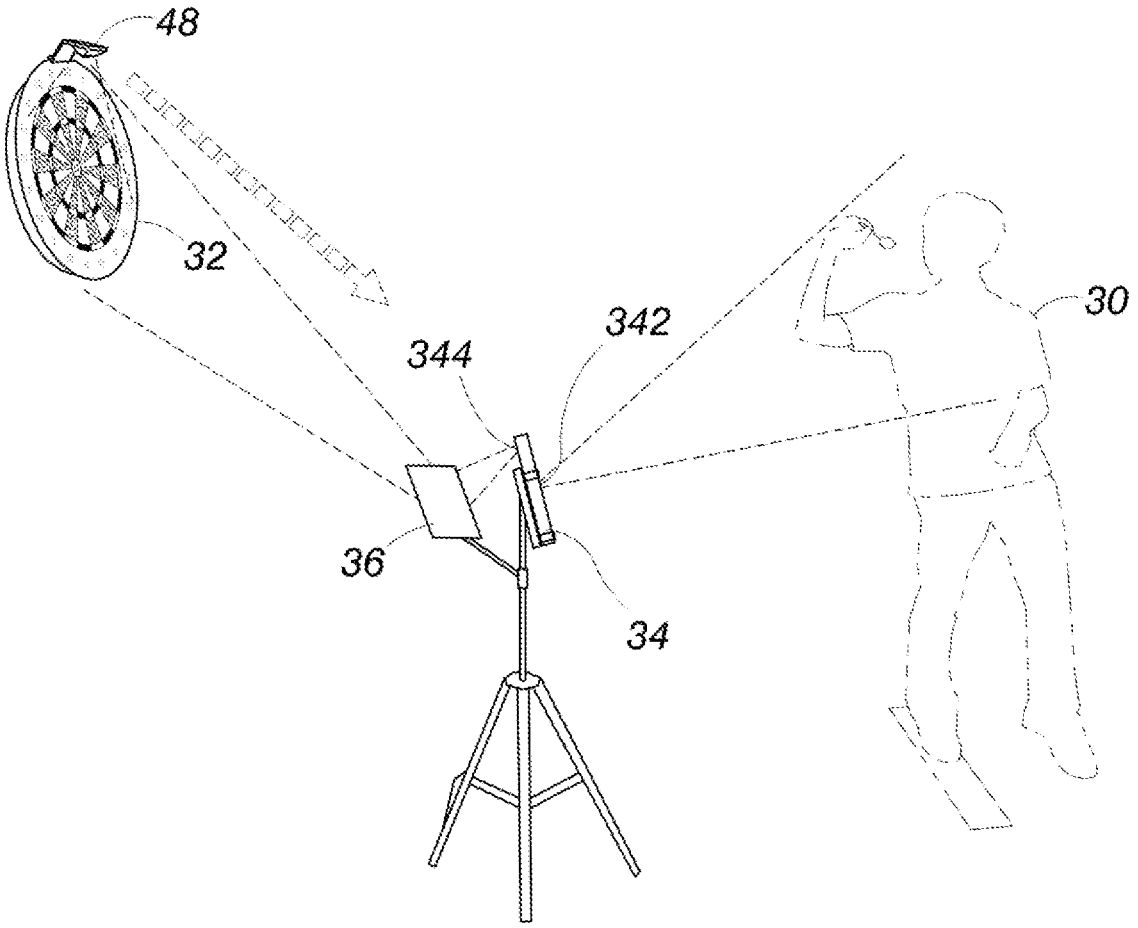
FIG. 9 is a schematic diagram of the embodiment with a second score sensing module additionally arranged in the present invention.

The present invention may further utilize external score sensing modules 45 to sense the scores on the dartboards, and FIG. 8 and FIG. 9 separately show two embodiments, with the score sensing modules additionally arranged, in the present invention. In the embodiment in FIG. 8, at least one first score sensing module 46, which may be a camera, is arranged between the dartboard 32 and the mobile device 34. The first score sensing module 46 is provided with one or more cameras and a process module. The dartboard image 32 may be captured by the camera and then analyzed by the process module to calculate a landing point position of the dart and a score corresponding to the landing point position. Each of the score corresponding the landing point or the sum of that may be understood as meaning the dart player score. Next, the first score sensing module 46 transmits the calculated dart score to the mobile device 34 through the wireless transmission technology. In the embodiment in FIG. 9, at least one second score sensing module 48, which may be a camera, is arranged nearby the dartboard 32, a specific position may be the outer ring position of the dartboard 32, and for example, in FIG. 9, the second score sensing module 48 is arranged on an upper edge of the dartboard 32; and the second score sensing module 48 is provided with one or more cameras and a process module. The camera is arranged to irradiate a target surface at an angle making an included angle with the target surface greater than 10 degrees (the angle at which the image of the whole dartboard 32 can be captured) to capture the dartboard image 32. The dartboard image 32 is then analyzed by the process module of the second score sensing module 48 to calculate a landing point position of the dart and a score corresponding to the landing point position. Next, the second score sensing module 48 transmits the calculated dart score to the mobile device 34 through the wireless transmission technique. The wireless transmission technology used in the above-mentioned embodiments in FIGS. 8 and 9 may be Bluetooth, Wi-Fi or other wireless communication modes. After the online match, league or tournament application of the mobile device 34 receives the dart score, the scoring module will fill in the score field with it.

By means of the online dart competition system provided by the present invention, dart players all over the world may easily participate in, without having an expensive electronic dart machine console with an online function, the online dart competition with dart players in other regions through the online match, league or tournament application installed on respective mobile devices to be online with the cloud server. In addition, the front and rear cameras and lens glass of the mobile devices themselves are further utilized to simultaneously capture the images of the dart player and the dartboard, and the images are broadcast, without additionally erecting a camera on the dartboard, live through the cloud server. Moreover, even if certain mobile devices are only provided with a single lens or cannot simultaneously turn on the front and rear cameras, the present invention may also make the mobile devices be externally connected to one Webcam or miniature camera, and the photographed images are uploaded to the cloud server through the mobile devices. Through the online dart competition system of the present invention, multiple persons may be integrated to form a plurality of competition modes such as regional battle, network battle, regional league, remote league, regional tournament and remote tournament, and the competition may even be open to the viewers, such that the viewers can remotely view the competition in a mode that the media device is online with the cloud server. Therefore, the present invention may save the cost of purchasing the expensive electronic dart machine console with the functions of being online, image capturing and live broadcast, and even if only a traditional wood or plastic dartboard is hung on a wall, as long as the lenses of the mobile devices and the internally installed online match, league or tournament applications are combined, the dart player may easily battle with others in an online mode through a simple dartboard at any place.

The above mentioned is only the preferred embodiments of the present invention and is not intended to limit the scope of the implementation of the present invention. Therefore, any equivalent changes or modifications made according to the features and spirit described within the scope of the present invention should be included within the claims of the present invention.

What is claimed is:

1. An online dart competition system, comprising:

at least two mobile devices, each comprises:

a first image capturing module, configured to capture a dart player image from a dart player;

a minor, arranged in front of or beside the mobile device and configured to reflect or redirect a dartboard image of a dartboard;

a second image capturing module, configured to capture the dartboard image from the mirror;

a score input element, configured to receive a dart player score corresponding to the dartboard image either inputted manually by the dart player via a touch panel or other user input device, or received from a score sensing module;

a display;

a processor, connected with the first image capturing module, the second image capturing module, the score input element, and the display; and a wireless transmission module, connected with the first image capturing module, the second image capturing module, and the processor, wherein the wireless transmission module is configured to transmit the dart player score, the dart player image and the dartboard image to the other mobile device and is configured to receive a competitor score, a competitor image and a competitor dartboard image from the other mobile device; and wherein the processor executes an online match, league or tournament application and then simultaneously displays the dart player score, the competitor score, and at least two images of the dart player image, the dartboard image, the competitor image, and the competitor dartboard image on the display in a split-screen interface, and the online match, league or tournament application is configured to record the dart player score and the competitor score.

2. The online dart competition system of claim 1, wherein the processor comprises a scoring module configured to record and sum up the dart player score of each dart on the dartboard.

3. The online dart competition system of claim 1, the score sensing module is arranged on or nearby the dartboard and comprises:

at least one camera, configured to capture the dartboard image; and a process module, connected to the at least one camera, and configured to receive the dartboard image and to calculate a landing point position of each dart according to the dartboard image and then calculate the dart player score.

4. The online dart competition system of claim 2, the score sensing module is arranged on or nearby the dartboard and comprises:

at least one camera, configured to capture the dartboard image; and a process module, connected to the at least one camera, and configured to receive the dartboard image and to calculate a landing point position of each dart according to the dartboard image, and then calculate the dart player score.

5. The online dart competition system of claim 1, wherein the split-screen interface comprises a score field, and the online match, league or tournament application performs a first display mode and a second display mode, in the first display mode, the online match, league or tournament application displays the number of rounds, a score of each round, and a game count of the dart player and the competitor on the score field; and in the second display mode, the online match, league or tournament application displays the game count on the score field.

6. The online dart competition system of claim 1, further comprising a cloud server, connected with the wireless transmission module of the at least two mobile devices and configured to receive, transmit, and record the dart player score, the competitor score, the dart player image, the dartboard image, the competitor image, and the competitor dartboard image and the score of each dart.

7. The online dart competition system of claim 6, further comprising at least one media device, connected with the cloud server for displaying the dart player score, the competitor score, the dart player image, the dartboard image, the competitor image, and the competitor dartboard image.

8. The online dart competition system of claim 1, wherein the processor comprises an image processing module, configured to zoom, turn, or cut the at least two images and then combine the at least two images in the split-screen interface.

9. The online dart competition system of claim 1, wherein the first image capturing module is a front camera of the mobile device.

10. The online dart competition system of claim 1, wherein the second image capturing module is a rear camera of the mobile device.

11. An online dart competition system, comprising:

at least two mobile devices, each comprises:

a first image capturing module, configured to capture a dart player image from a dart player;

a second image capturing module, connected with the mobile device through a transmission cable and configured to capture a dartboard image from a dartboard and configured to transmit the dartboard image to the mobile device after capturing the dartboard image;

a score input element, configured to receive a dart player score corresponding to the dartboard image either inputted manually by the dart player via a touch panel or other user input device, or received from a score sensing module;

a display;

a processor, connected with the first image capturing module, the second image capturing module, the score input element, and the display; and a wireless transmission module, connected with the first image capturing module, the second image capturing module, and the processor, wherein the wireless transmission module is configured to transmit the dart player score, the dart player image and the dartboard image to the other mobile device and is configured to receive a competitor score, a competitor image and a competitor dartboard image from the other mobile device; and wherein the processor executes an online match, league or tournament application and then simultaneously displays the dart player score, the competitor score, and at least two images of the dart player image, the dartboard image, the competitor image, and the competitor dartboard image on the display in a split-screen interface, and the online match, league or tournament application is configured to record the dart player score and the competitor score.

12. The online dart competition system of claim 11, wherein the processor comprises a scoring module configured to record and sum up the dart player score of each dart on the dartboard.

13. The online dart competition system of claim 11, the score sensing module is arranged on or nearby the dartboard and comprises:

at least one camera, configured to capture the dartboard image; and a process module, connected to the at least one camera, and configured to receive the dartboard image and to calculate a landing point position of each dart according to the dartboard image and then calculate the dart player score.

14. The online dart competition system of claim 12, the score sensing module is arranged on or nearby the dartboard and comprises:

at least one camera, configured to capture the dartboard image; and a process module, connected to the at least one camera, and configured to receive the dartboard image and to calculate a landing point position of each dart according to the dartboard image, and then calculate the dart player score.

15. The online dart competition system of claim 11, wherein the split-screen interface comprises a score field, and the online match, league or tournament application performs a first display mode and a second display mode, in the first display mode, the online match, league or tournament application displays the number of rounds, a score of each round, and a game count of the dart player and the competitor on the score field; and in the second display mode, the online match, league or tournament application displays the game count on the score field.

16. The online dart competition system of claim 11, further comprising a cloud server, connected with the wireless transmission module of the at least two mobile devices and configured to receive, transmit, and record the dart player score, the competitor score, the dart player image, the dartboard image, the competitor image, and the competitor dartboard image and the score of each dart.

17. The online dart competition system of claim 16, further comprising at least one media device, connected with the cloud server for displaying the dart player score, the competitor score, the dart player image, the dartboard image, the competitor image, and the competitor dartboard image.

18. The online dart competition system of claim 11, wherein the processor comprises an image processing module, configured to zoom, turn, or cut the at least two images and then combine the at least two images in the split-screen interface.

19. The online dart competition system of claim 11, wherein the first image capturing module is a front camera of the mobile device.

20. The online dart competition system of claim 11, wherein the second image capturing module is a miniature camera or Webcam.

* * * * *